US006161316A

United States Patent [19]

Bolon

[11] Patent Number: 6,161,316

[45] Date of Patent: Dec. 19, 2000

[54] INVISILOG

[76] Inventor: Judith A. Bolon, 121 N. Balsamina, Portola Valley, Calif. 94028

[21] Appl. No.: 08/999,982

[22] Filed: Jun. 20, 1997

[51] Int. Cl.[7] ..... B42F 21/00

[52] U.S. Cl. ..... 40/360; 428/43; 462/22

[58] Field of Search ..... 428/43; 462/22, 462/24, 19, 58, 68; 283/105; 40/360

[56] References Cited

U.S. PATENT DOCUMENTS

| | | | |
|---|---|---|---|
| 1,104,310 | 7/1914 | Price | 462/68 |
| 1,393,213 | 10/1921 | Gilbert | 428/43 |
| 1,637,156 | 7/1927 | Mirski | 283/105 |
| 3,620,553 | 11/1971 | Donovan | 462/24 |

*Primary Examiner*—Joanne Silbermann

[57] ABSTRACT

The visitor registers on the Invisilog by printing in one of the ten sections on Page One (Figure One). Each section is perforated to tear out and insert in a standard plastic badge holder which is worn as an identification badge. The registration information transfers to Page Three but does not transfer to Page Two. This information transfer is achieved by mechanical pressure on carbonless paper which is coated on the back of Page Two and coated on the front of Page Three. The first page (Badge Page) is attached at the bottom edge to the second page (Privacy Page).

The second (Privacy Page) and third page (Visitor Log Page) are attached at the top and bottom. The Privacy Page acts as a blockout over the Visitor Log Page. The Visitor Log Page has received the entry information from Page One. The security guard or receptionist can separate Pages Two (for disposal) and Three (for filing).

6 Claims, 2 Drawing Sheets

INVISILOG

BRIEF SUMMARY OF THE INVENTION

The Invisilog is a three page set which combines identification badges with a confidential visitor log.

BRIEF DESCRIPTION

Invisilog is a three page set composed of the Badge Page (Figure One), the Privacy Page (Figure Two) and the Visitor Log Page (Figure Three). The design and construction allow entries which are printed by visitors on the Badge Page to be replicated on the Visitor Log Page yet remain screened from view by the Privacy Page.

DETAILED DESCRIPTION

Figure 1:
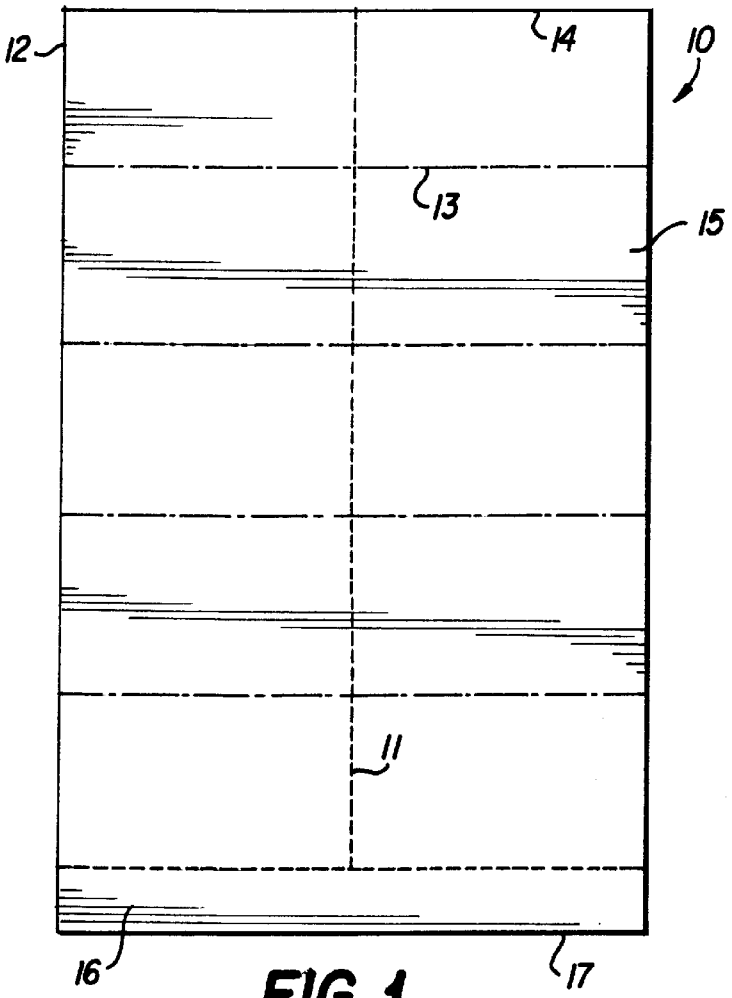

Figure One FIG. 1: Badge Page 10

Figure 2:
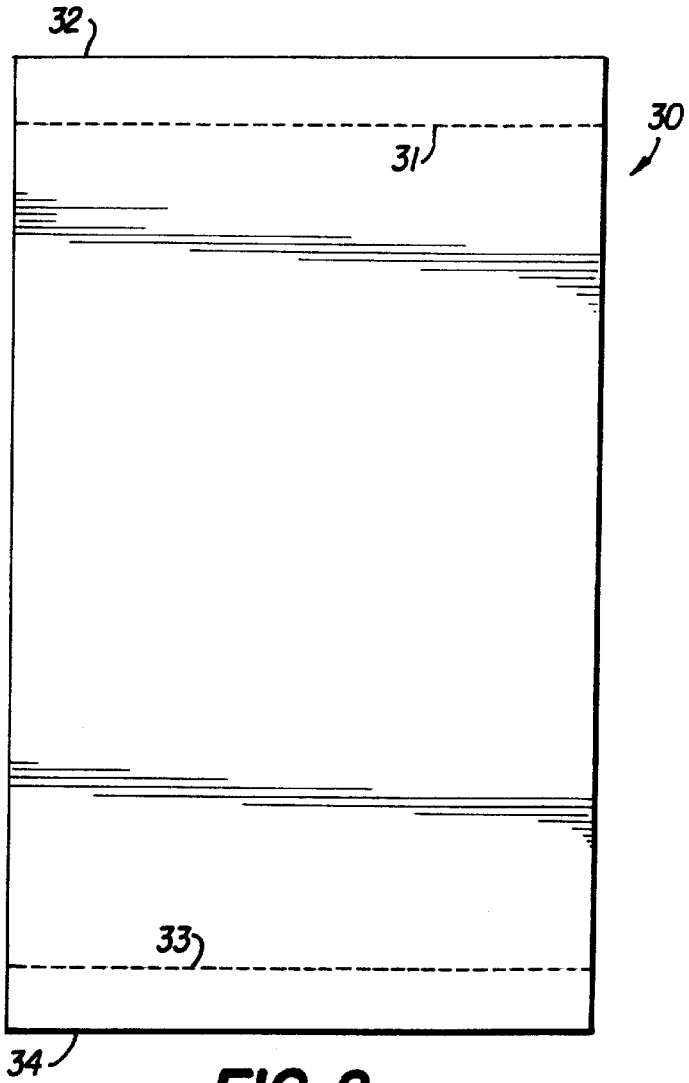

- 7"×11.75" bond paper
- one vertical perforation 11 3.5" from left edge 12
- five horizontal perforations 13 at 2 3/16" intervals beginning from top edge 14
- custom printing on ten sections 15 creates ten 3.5"×2 3/16" identification badges
- 7"×0.75" bottom section at the bottom edge 17 is attached at the back to the front of page two
- printing on 7"×0.75 bottom section Figure Two FIG. 2: Privacy Page 36

Figure 3:
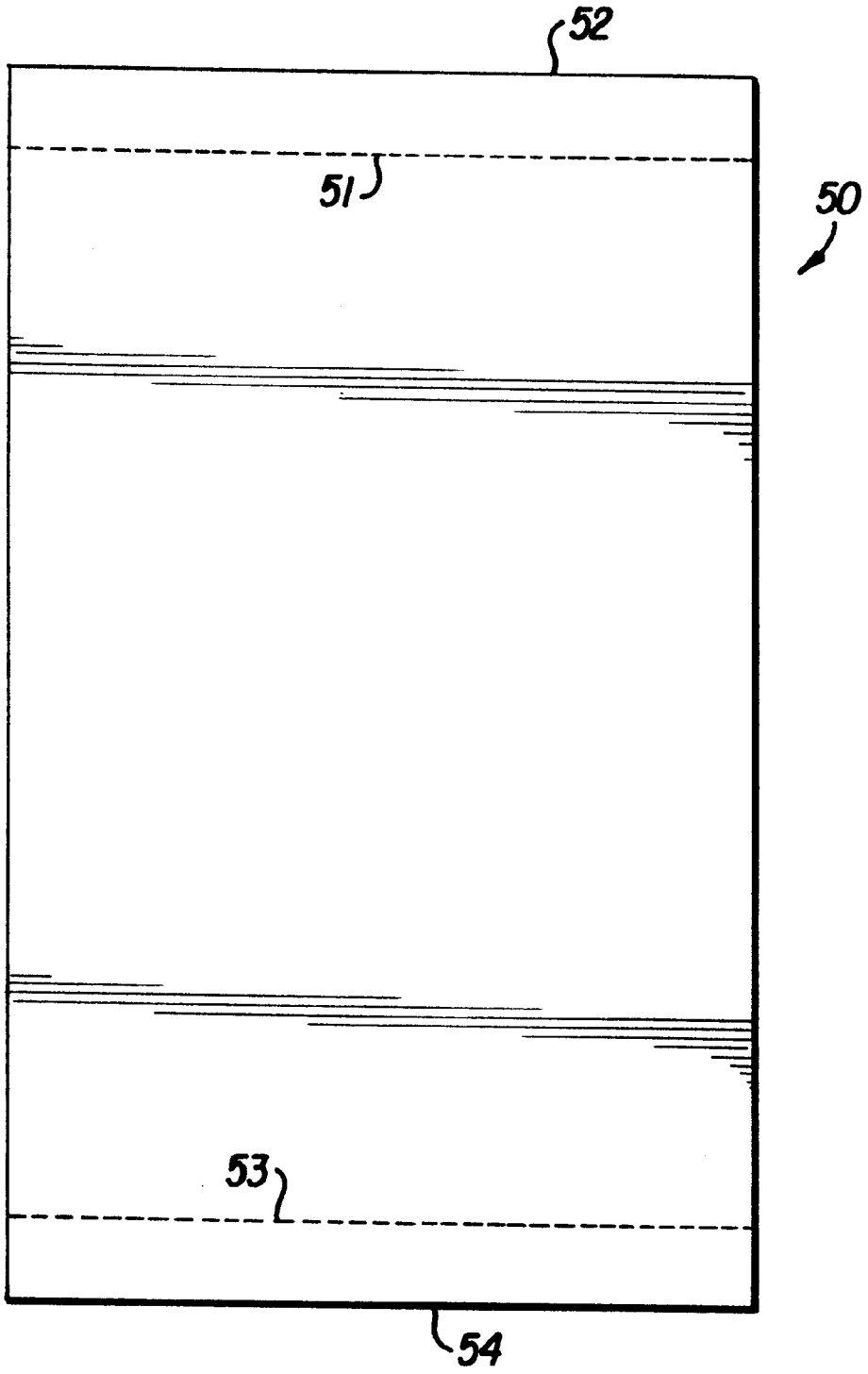

- 7"×12.5" mechanical transfer carbonless paper with coated back
- one horizontal perforation 31 0.75 from top edge 32
- one horizontal perforation 33 0.75" from bottom edge 34
- front bottom edge of part two is attached to back bottom edge of part one
- back of part two is attached at bottom edge and top edge to front edge and bottom edge of part three
- printed on front Figure Three FIG. 3: Visitor Log Page 50

- 7"×12.5" mechanical transfer carbonless paper with coated front
- one horizontal perforation 51 0.75" from top edge 52
- one horizontal perforation 53 0.75" from bottom edge 54
- front top edge and front bottom edge of part three are attached to back top edge and back bottom edge, respectively of part two
- text printed on the front 2. Drawings Figure One: Badge Page Figure Two: Privacy Page Figure Three: Visitor Log Page

What is claimed is:

1. A system for the inscription and secure recordation of information comprising:

(a) an inscription page comprising (i) a plurality of detachable perforated inscription spaces and (ii) an inscription attaching section;

(b) a carbonless privacy page, said privacy page comprising (i) a privacy section and (ii) at least first and second opposed privacy attaching sections; and (c) a carbonless recordation page, said recordation page comprising (i) a recordation section and (ii) at least first and second opposed recordation attaching sections;

said inscription attaching section being removably attached to one of said at least first and second opposed privacy attaching sections, and said at least first and second opposed privacy attaching sections being removably attached to a corresponding one of said at least first and second opposed recordation attaching sections.

2. A system according to claim 1, wherein any of said plurality of inscription spaces is an identification badge.

3. A method of inscribing and securely recording information by means of the system of claim 1 comprising an inscription page having a plurality of detachable sections, a carbonless privacy page having a coated back, and a carbonless recordation page having a coated front, said inscription page, said privacy page, and said recordation page being removably attached, whereby when said inscription page is inscribed, an inscription is transferred to said recordation page, said method comprising:

(a) inscribing one or a plurality of said detachable sections;

(b) detaching said inscribed detachable sections until said plurality of detachable sections is depleted;

(c) detaching said recordation page from said privacy page and disposing of said privacy page so as to provide a record of each inscription.

4. A method according to claim 3, wherein each of said plurality of detachable sections is an identification badge.

5. A system for the inscription and secure recordation of information comprising:

(a) an inscription page comprising (i) an inscription top edge, an inscription bottom edge, an inscription first side edge, and an inscription second side edge; (ii) a vertical perforation disposed equidistant between said inscription first side edge and said inscription second side edge, and extending from said inscription top edge to said inscription bottom edge; (iii) a plurality of parallel horizontal perforations extending from said inscription first side edge to said inscription second side edge; and (iv) an inscription bottom attaching section disposed between one of said horizontal perforations located nearest to said inscription bottom edge and said inscription bottom edge;

(b) a carbonless privacy page comprising (i) a privacy top edge, a privacy bottom edge, a privacy first side edge, a privacy second side edge, and a coated back; (ii) a privacy top attaching section disposed between a privacy top edge and a horizontal perforation extending from said privacy first side edge to said privacy second side edge and located proximate to said privacy top edge, said privacy top attaching section having a size equal to that of said inscription bottom attaching section; (iii) a privacy section; and (iv) a privacy bottom attaching section disposed between a privacy bottom edge and a horizontal perforation extending from said privacy first side edge to said privacy second side edge and located proximate to said privacy bottom edge, said privacy bottom attaching section having a size equal to that of said inscription bottom attaching section; and (c) a carbonless recordation page comprising (i) a recordation top edge, a recordation bottom edge, a recordation first side edge, a recordation second side edge, and a coated front; (ii) a recordation top attaching section disposed between a recordation top edge and a horizontal perforation extending from said recordation first side edge to said recordation second side edge and located proximate to said recordation top edge, said recordation top attaching section having a size equal to that of said inscription bottom attaching section; (iii) a recordation section; and (iv) a recordation bottom attaching section disposed between a recordation bottom edge and a horizontal perforation extending from said recordation first side edge to said recordation second side edge and located proximate to said recordation bottom edge, said recordation bottom attaching section having a size equal to that of said inscription bottom attaching section;

said privacy top attaching section being removably attached to said recordation top attaching section, said inscription bottom attaching section being removably attached to said privacy bottom attaching section, and said privacy bottom attaching section being removably attached to said recordation bottom attaching section.

6. A system according to claim 5, wherein on said inscription page a space defined by said edges, said vertical perforation, and said plurality of horizontal perforations is a detachable identification badge.

* * * * *